US005703431A

United States Patent [19]

Itou et al.

[11] Patent Number: 5,703,431

[45] Date of Patent: Dec. 30, 1997

[54] DISPLAY SCREEN AND METHOD OF MANUFACTURING THE SAME

[75] Inventors: Takeo Itou, Kumagaya; Hidemi Matsuda, Fukaya, both of Japan

[73] Assignee: Kabushiki Kaisha Toshiba, Kawasaki, Japan

[21] Appl. No.: 579,609

[22] Filed: Dec. 26, 1995

[30] Foreign Application Priority Data

Dec. 26, 1994 [JP] Japan ..... 6-322059

[51] Int. Cl.[6] ..... H01J 29/10

[52] U.S. Cl. ..... 313/461; 313/463; 313/466; 313/473

[58] Field of Search ..... 313/461, 463, 313/466, 473

[56] References Cited

U.S. PATENT DOCUMENTS

| | | | |
|---|---|---|---|
| 2,959,483 | 11/1960 | Kaplan . | |
| 3,114,065 | 12/1963 | Kaplan . | |
| 4,021,588 | 5/1977 | Royce et al. | 313/466 |
| 4,251,610 | 2/1981 | Haven et al. | 430/25 |
| 4,392,077 | 7/1983 | Libman | 313/474 |
| 4,551,652 | 11/1985 | Compen et al. | 313/466 |
| 5,045,750 | 9/1991 | Itou et al. | 313/461 |
| 5,199,984 | 4/1993 | Jeong | 313/466 |
| 5,340,673 | 8/1994 | Tateyama et al. | 430/23 |

FOREIGN PATENT DOCUMENTS

| | | |
|---|---|---|
| 0 322 200 | 6/1989 | European Pat. Off. . |
| 0 613 167 | 8/1994 | European Pat. Off. . |
| 54-000563 | 1/1979 | Japan . |
| 5-266795 | 10/1993 | Japan . |
| 5-275006 | 10/1993 | Japan . |
| 2 240 213 | 7/1991 | United Kingdom . |

*Primary Examiner*—Sandra L. O'Shea
*Assistant Examiner*—Vip Patel
*Attorney, Agent, or Firm*—Cushman Darby & Cushman IP Group of Pillsbury Madison & Sutro LLP

[57] ABSTRACT

There is disclosed a display screen including a transparent substrate, color optical filters formed on the substrate, and a black matrix layer formed on the filters and consisting of black pigment particles. Phosphor layers are formed on the color optical filters on which the black matrix layer is formed.

8 Claims, 4 Drawing Sheets

DISPLAY SCREEN AND METHOD OF MANUFACTURING THE SAME

BACKGROUND OF THE INVENTION

1. Field of the Invention

The present invention relates to a display screen used in a color cathode ray tube.

The present invention particularly relates to a display screen having an optical color filter layer formed between a phosphor layer and a substrate, and a method of manufacturing the display screen.

2. Description of the Related Art

A conventional color television tube used in practice includes an envelope. The envelope includes a panel having a phosphor screen formed on its inner surface and a funnel continuous with this panel. An electron gun unit assembly is arranged in the neck portion of the funnel. Electron beams emitted from the electron gun are deflected and scanned by a magnetic field generated by a deflection yoke mounted on the outer surface of the envelope, thereby forming an image.

This phosphor screen has a black matrix formed on the inner surface of a faceplate, consisting of black pigment particles, and having circular, rectangular, or stripe-shaped holes at predetermined positions. The phosphor screen also has circular, rectangular, or stripe-shaped phosphor layers which fill the holes.

A so-called tint panel or dark tint panel is generally used as a low-transmittance faceplate to attenuate external light reflection components and increase the contrast ratio in a color television tube. When this faceplate is used, emission from the phosphors is attenuated in addition to the attenuation of the external light reflection components, resulting in inconvenience.

A technique shown in Jpn. Pat. Appln. KOKAI Publication No. 5-275006, or the like, has recently received a great deal of attention. In this technique, filter patterns constituted by phosphor layers, and pigment layers corresponding to the emission colors of the respective phosphors of the phosphor layers are formed between the phosphor layers and the faceplate to suppress the reflection at the face of the phosphor layers. Thus, the contrast is increased.

FIG. 1 is a schematic sectional view for explaining a conventional display screen. As shown in FIG. 1, to manufacture a phosphor screen with filters in which red, green, and blue filters RF, GF, BF, and red, green, and blue emission phosphor layers RP, GP, and BP are formed in the holes of a black matrix BM. The step of forming the filters RF, GF, and BF on the front surfaces of the phosphor layers RP, GP, and BP, i.e., on the faceplate 10 side, is required in addition to the conventional manufacturing process of the phosphor screen. Most of the methods recently proposed for this purpose form a filter pattern prior to formation of the phosphor layers, but after the black matrix BM is formed on the inner surface of the faceplate.

As another method of suppressing the reflection described above, an optical interference film corresponding to emission of phosphors is formed between phosphor layers and a faceplate, as shown in Jpn. Pat. Appln. KOKAI Publication No. 54-563. In view of the number of manufacturing steps and cost, however, a method of forming pigment particle layers in correspondence with the respective phosphors is superior to the above method.

According to the method of forming a filter pattern consisting of pigment particle layers between phosphor layers and a faceplate, even if a high-transmittance faceplate is used, the contrast and emission brightness can be theoretically increased. An irregular reflection component of black pigment particles can not be suppressed. However an expected effect of suppressing external light reflection cannot be obtained if the optical filter pattern is simply formed between the phosphor layers and the faceplate in the holes. For this reason, sufficiently high brightness and contrast levels cannot be desirably obtained.

In the conventional method of manufacturing the phosphor screen with filters, the black matrix under the pigment layers peels off the substrate during the manufacture, and more specifically, at the stage in which filter layers are formed on the substrate having the black matrix and patterned.

SUMMARY OF THE INVENTION

The present invention has been made in consideration of the conventional problems described above, and has as its object an efficient suppression of external light reflection on a filter substrate with a black matrix and a color television tube.

It is another object of the present invention to provide a method of manufacturing a filter substrate and a color television tube free from the peeling of a black matrix during the manufacture.

According to the first aspect of the present invention, there is provided a display screen comprising:

a transparent substrate;

optical filter layers containing color pigment particles having an average particle size of 0.2 μm or less and formed on the transparent substrate as rectangular or circular dots or stripes;

a black matrix layer containing black pigment particles having an average particle size of 0.2 to 5 μm and formed to cover peripheral regions of the filter layers except for central portions thereof; and phosphor layers formed on the optical filter layers and having an emission color corresponding to a color of a pigment contained in the optical filter layers.

According to the second aspect of the present invention, there is provided a method of manufacturing a display screen, comprising the step of:

coating and drying a color pigment dispersion containing color pigment particles having an average particle size of 0.2 μm or less on a transparent substrate to form a color pigment layer, and patterning the color pigment layer to form optical pigment layers as rectangular or circular dots or stripes;

coating and drying a black pigment dispersion containing black pigment particles having an average particle size of 0.2 to 5 μm on the color pigment layers to form a black pigment layer, and patterning the black pigment layer to partially remove the black pigment layer except for peripheral regions of the pigment layers so as to expose at least central portions of the optical filter layers, thereby obtaining a black matrix layer covering the peripheral regions of the color optical filter layers; and coating a slurry containing a phosphor on the color pigment layers to form a phosphor slurry layer, and patterning the phosphor slurry layer to optionally form phosphor layers having an emission color corresponding to a color of a pigment containing the optical filter layers on the optical filter layers.

According to the present invention, since the filter layers consisting of fine particle pigments are formed between the substrate and the black matrix consisting of black pigment particles, components irregularly reflected by the black pigment particles can be suppressed to improve the contrast characteristics of the display screen with respect to external light. Therefore, when the display screen of the present invention is used, a color cathode ray tube which is excellent in brightness and contrast can be obtained.

According to the manufacturing method of the present invention, materials are patterned from the one having a smaller particle size. The lower pattern already formed in the manufacturing process will not peel off in patterning an upper layer, thereby providing an excellent display screen and an excellent color cathode ray tube.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
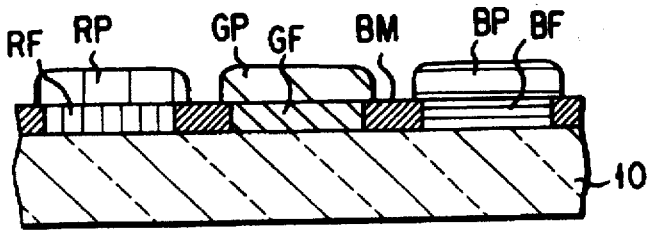
FIG. 1 (PRIOR ART)
FIG. 1 is a schematic sectional view for explaining a conventional display screen.

The present inventors examined the causes for the problems of a conventional display screen with filters, i.e., i) the failure of providing an expected effect of preventing external light reflection, and ii) easy peeling of a black matrix layer during the manufacture.

As for problem i), irregular reflection caused by pigment particles which form a black matrix was found to be noticeable with an increase in transmittance of a faceplate. High brightness and contrast levels which could be expected upon employment of filters could not be obtained due to this irregular reflection.

More specifically, since the pigment particles contained in the optical filter layers formed between the faceplate and the phosphor layers have an average particle size of about 0.2 μm, or less irregular reflection caused by the particles does not occur. However, since the black pigment particles contained in the black matrix layer have a relatively large particle size of 0.2 to 5 μm, the external light is irregularly reflected by the black matrix layer. This irregular reflection does not pose a problem in a conventional faceplate because its transmittance is low. With an increase in transmittance of the faceplate, irregular reflection in the black matrix layer is not attenuated and becomes noticeable.

In a conventional color cathode ray tube having a filter substrate and phosphor layers with filters, no countermeasure is taken for the black matrix layer serving as a non-emission portion. That is, no counter measure is taken to prevent irregular reflection in the black matrix layer. This is the cause for the failure of providing the expected effect of preventing external light reflection.

As for problem ii), the filter layers and the black matrix layer are found to have different forces based on film shrinkage during film drying, thereby causing the peeling of the black matrix during the manufacturing process.

This will be described below in detail.

The force based on film shrinkage during the film drying is represented by equation I below:

$$P=2\gamma/r \qquad \text{equation I}$$

where P is the shrinkage force, γ is the surface tension, and r is the radius of the air gap.

As the particle size decreases, the radius r of the air gap decreases. For this reason, it is found from equation I that the shrinkage force P increases with a decrease in particle size.

Since the average particle size of the pigment particles used in the optical filter layers falls within the range of about 0.20 μm or less and the average particle size of the black pigment particles used in the black matrix layer falls within the range of 0.2 to 5 μm, a large difference is present between the shrinkage forces of the black matrix layer and the optical filter layers. Therefore, the difference between the shrinkage forces of the black matrix layer and the optical filter layers is found to be the cause of peeling of the black matrix layer from the optical filter layers.

Judging from the above fact, the present inventors have confirmed that problems i) and ii) can be solved by implementing the arrangement so as to eliminate the influences of the shrinkage force of the optical filter layers and have reached the present invention.

According to the first aspect of the present invention, there is provided a display screen comprising:

a transparent substrate;

optical filter layers containing color pigment particles having an average particle size of 0.2 μm or less and formed on the transparent substrate as rectangular or circular dots or stripes;

a black matrix layer containing black pigment particles having an average particle size of 0.2 to 5 μm and formed to cover peripheral regions of the filter layers except for central portions thereof; and phosphor layers formed on the optical filter layers and having an emission color corresponding to a color of a pigment contained in the optical filter layers.

In a conventional display screen, a black matrix layer is directly formed on a faceplate, and no optical filter layers are present between the black matrix layer and the faceplate. In the display screen according to the present invention, however, the optical filter layers are formed at least partially between the black matrix layer and the faceplate. These optical filter layers can suppress irregular reflection of external light on the black matrix layer. Therefore, a color cathode ray tube having this display screen can have higher contrast and brightness levels.

When the optical filter layers of the respective colors are formed as, e.g., circular dots, a gap is formed between the circles of the filter layers. The black matrix layer is directly formed on the substrate and no optical filter layer is present in this gap. Thus, the optical filter layer is formed partially between the black matrix layer and the faceplate. In contrast, when the optical filter layers of the respective colors are formed as, e.g., stripes so as to cover the entire surface of the substrate without any gap, the optical filters are interposed entirely between the black matrix layer and the substrate. Therefore, irregular reflection caused by the black pigment particles can be more effectively prevented on the entire surface of the substrate.

The second aspect of the present invention represents a method of manufacturing the display screen of the first aspect. There is provided a method of manufacturing a display screen, comprising the steps of:

coating and drying a color pigment dispersion containing color pigment particles having an average particle size of 0.2 μm or less on a transparent substrate to form a color pigment layer, and patterning the color pigment layer to form color optical filter layers as rectangular or circular dots or stripes;

coating and drying a black pigment dispersion containing black pigment particles having an average particle size of 0.2 to 5 μm on the color pigment layers to form a black pigment layer, and patterning the black pigment layer to partially remove the black pigment layer except for peripheral regions of the color optical filter layers so as to expose at least central portions of the optical filter layers, thereby obtaining a black matrix layer covering the peripheral regions of the color optical filter layers; and coating a slurry containing a phosphor on the color optical filter layers to form a phosphor slurry layer, and patterning the phosphor slurry layer to optionally form phosphor layers having an emission color corresponding to a color of a pigment containing the optical filter layers on the optical filter layers.

The color optical filter layers are formed in units of colors by repeating the step of coating a dispersion including a color pigment and a resist to form a coating film, the step of exposing the coating film, and developing the exposed coating film. If the resultant color optical filter layers are formed as circular dots, they have gaps between themselves.

The color optical filter layers can also be formed by the following method. Assume that color optical filter layers of n colors are to be formed. Prior to coating of the first color pigment dispersion, a resist solution is coated on a substrate to form a resist film. The resist film is exposed and developed to form a resist film pattern in a region where the color optical filter layers of the second to nth colors are to be formed. The first pigment dispersion is coated and dried on the resist film pattern to form a coating film. A resist decomposition solution is coated on the first pigment dispersion coating film to remove the resist film pattern and the first color pigment dispersion coating film formed thereon in the region where the color optical filter layers of the second to nth colors are to be formed. Thus the substrate is exposed in this region.

The second pigment dispersion is coated on the exposed substrate to form a coating film. The coating film is exposed and developed. The coating film is patterned into optical filter layers of the second color. Similarly, coating films up to the nth color are sequentially patterned until the color optical filter layers of the nth color are formed. In the resultant color optical filters, portions corresponding to the gaps between the color optical filter layers formed in the former method are buried with the first color optical filters. No gaps are formed in this latter method. If the optical filter layers are formed as circular dots, the display screen manufactured by the latter method can more effectively suppress irregular reflection caused by the black pigment particles than that manufactured by the former method.

The black matrix layer, for example, can be formed as follows.

A resist solution is coated to form a resist coating film. The resist coating film is exposed, developed, and patterned to form a resist layer pattern in a prospective phosphor layer formation region near the central portion of each color optical filter layer. A black pigment dispersion is coated on the color optical filter layers, on which the resist layer pattern is formed, to form a black pigment layer. A resist decomposition agent is coated on the black pigment layer to remove the resist layer and the black pigment layer in the region where the phosphor layers are formed. As described above, a portion near the central portion of each optical filter layer is exposed, and the black matrix layer can be formed to cover the peripheral portion of each color pigment layer.

In a conventional method, optical filter layers are formed on a black matrix layer. The black matrix layer formed under the optical filter layers tend to peel off by the influence of a strong shrinkage force generated during coating and drying of the optical filter layers. According to the manufacturing method of the present invention, however, the pattern of the optical filter layers is formed prior to the formation of the black matrix layer. The black matrix layer is not adversely affected by the shrinkage force of the optical filter layers. A weak shrinkage force generated in coating and drying of the black matrix layer is not strong enough to cause peeling of the optical filter layers formed under the black matrix layer. In other words, the film shrinkage force increases with a decrease in particle size. According to the manufacturing method of the present invention, a material having a larger film shrinkage force is formed first, thereby reducing the force that acts on the lower layer in patterning the upper layer. As described above, according to the present invention, a display screen with filters can be obtained without the peeling of the black matrix film.

Color pigment particles used in the present invention have an average particle size of 0.005 to 0.2 μm to obtain optical filters capable of transmitting desired light and having sufficiently high transparency and good film formation properties. Scattering is decreased when the particle size of color pigment particles is 0.2, or less smaller particles among color pigment particles have the particle size of 0.005 μm. Note that the desired particle size ranges within 0.01 to 0.15 μm. Examples of the pigments are as follows.

Examples of the red pigment are: Sicotrans Red L-2817 (tradename), which has particle size of 0.01 to 0.02 μm and is available from BASF), as a ferric oxide pigment, and Chlomofartal Red A2B (tradename), which has a particle size of 0.01 μm and is available from Ciba-Geigy) as an anthraquinone pigment. Examples of the blue pigment are: Cobalt Blue X (tradename), which has a particle size: 0.01 to 0.02 μm and is available from Toyo Ganryo, as a cobalt aluminate ($Al_2O_3$—CoO) pigment; and Lionol Blue FG-7330 (tradename), which has a particle size of 0.01 and is available from Toyo Ink, as a phothalocyanine blue pigment. Examples of the green pigment are Dyeroxide TM-Green #3320 (tradename), which has a particle size: 0.01 to 0.02 μm and is available from DAINICHISEIKA COLOUR & CHEMICALS MFG. CO., LTD., as a $TiO_2$—NiO—CoO—ZnO pigment, Dyeroxide TM-Green #3340 (tradename), which has a particle size of 0.01 to 0.02 μm and is available from DAINICHISEIKA COLOUR & CHEMICALS MFG. CO., LTD., as a CoO—$Al_2O_3$—$Cr_2O_3$—$TiO_2$ pigment; Dipyroxide TM-green #3420 (tradename), which has a particle size of 0.01 to 0.02 μm and is available from DAINICHISEIKA COLOUR & CHEMICALS MFG. CO., LTD., as a CoO—$Al_2O_3$—$Cr_2O_3$ pigment; Fastgen Green S (tradename), which has a particle size of 0.01 μm and is available from DAINIPPON INK & CHEMICALS, INC., as a chlorinated phthalocyanine green pigment; and Fastgen Green 2YK (tradename), which has a particle size of 0.01 μm and is available from DAINIPPON INK & CHEMICALS, INC., as a brominated phthalocyanine green pigment.

The second pigment particles as the black pigment particles preferably have an average particle size of 0.2 to 5 μm, and can use graphite particles.

According to the method of the present invention, as described above, a fine particle pigment layer having a small particle size is formed in the manufacturing process of the phosphor screen. Even if the black pigment layer containing large particles is then formed and dried, and the resultant coating film is patterned, the underlying fine particle pigment layer pattern will not peel off. Thus, an excellent phosphor screen is obtained.

The present invention will be described in detail with reference to the accompanying drawings.

EXAMPLE 1

Figure 2A:
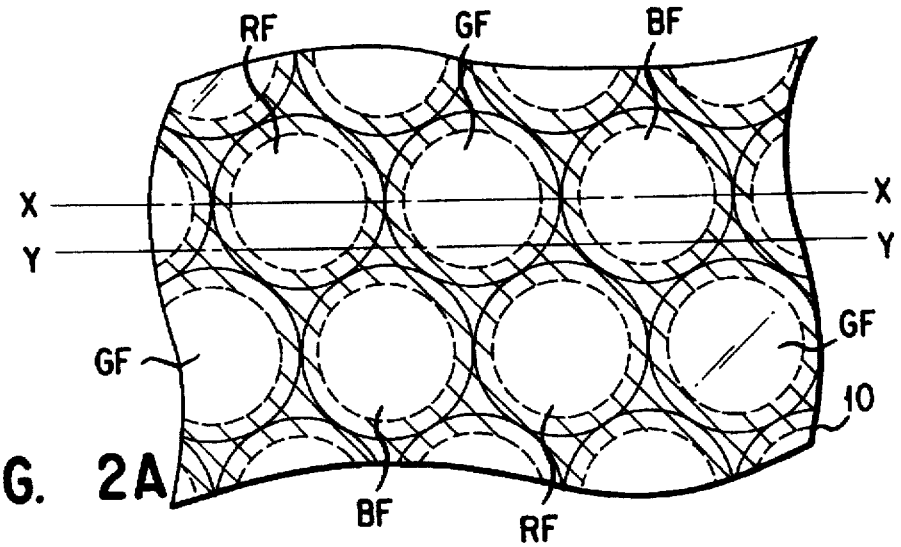
FIG. 2A is a schematic plan view showing a display screen according to the present invention.
Figure 2B:
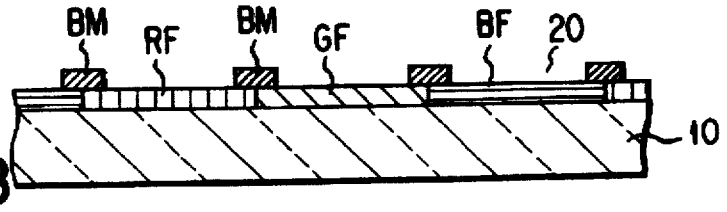
FIG. 2B is a sectional view of the display screen along the line X—X in FIG. 2A.
Figure 2C:
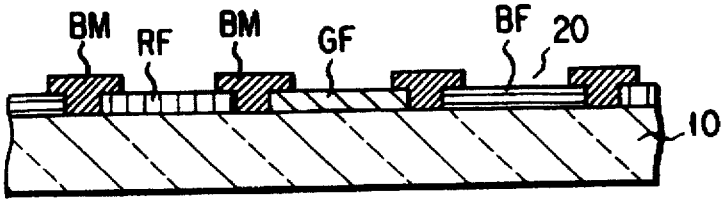
FIG. 2C is a sectional view of the display screen along the line Y—Y in FIG. 2A.

FIG. 2A is a schematic plan view showing a display screen in which optical filter layers as circular dots and a black matrix layer are formed on a substrate. FIGS. 2B and 2C are sectional views of the display screen along the lines X—X and Y—Y in FIG. 2A, respectively.

Referring to FIG. 2A, hatched lines represent a region where the black matrix layer is present, and portions surrounded by circles of dotted lines represent holes in which the black matrix layer is not present. Portions surrounded by circles of solid lines represent regions where optical filter layers as circular dots are formed. As shown in FIG. 2A, red, green, and blue filters RF, GF, and BF are formed adjacent to each other on a substrate 10. The red filter RF consists of a red pigment containing red iron oxide particles having an average particle size of 0.01 μm. The green filter GF consists of a green pigment containing cobalt green particles having an average particle size of 0.01 μm. The blue filter BF consists of a blue pigment containing cobalt blue particles having an average particle size of 0.01 μm.

As shown in FIGS. 2B and 2C, a layer BM containing graphite particles is formed as a black matrix layer on the optical filter layers BF, GF, and RF consisting of such color pigment particles. The black matrix layer BM is not formed in the central portions of the dot-like pigment layers RF, GF, and BF, i.e., the circular regions indicated by the broken lines to define holes 20, as shown in FIG. 2B. The black matrix BM is formed to cover the peripheral portions of the color filters RF, GF, and BF and a portion between the color filters except for the holes 20.

As shown in FIG. 2C, the black matrix BM is formed on the substrate 10 in an inter-dot region which is not filled even if the pigment particle layers as circular dots are densely arranged adjacent to each other. In this case, as can be apparent from FIGS. 2A and 2C, at least the region between the circle indicated by the solid line and the circle indicated by the broken line has a structure in which the corresponding optical filter layer is located between the black matrix layer BM and the substrate 10.

With this arrangement, the covering ratio of the fine particle pigment layers which cover the front surface, i.e., the substrate side of the black matrix is much higher in the display screen of the present invention than that of the conventional structure, 0%.

A method of manufacturing a display screen according to the present invention will be described below.

FIGS. 3A to 3G are sectional views for explaining a method of manufacturing the display screen according to the present invention.

Figure 3A:
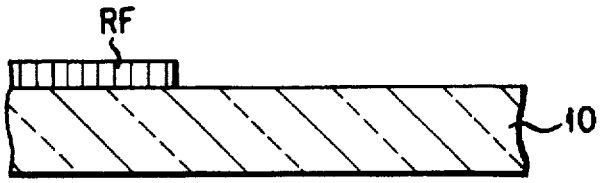
FIGS. 3A to 3G are sectional views for explaining a method of manufacturing the display screen according to the present invention.

As shown in FIG. 3A, red iron oxide particles are prepared as a red pigment, and an ammonium dichromate/poval photoresist is mixed therewith to prepare a red pigment dispersion. The resultant red pigment dispersion is coated on one surface of a clean transparent substrate 10 and dried. The red dot positions of the resultant coating film are exposed and developed to form red filters RF.

Figure 3B:
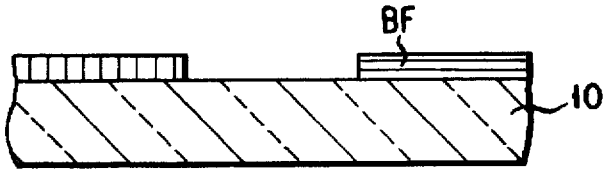
Figure 3C:
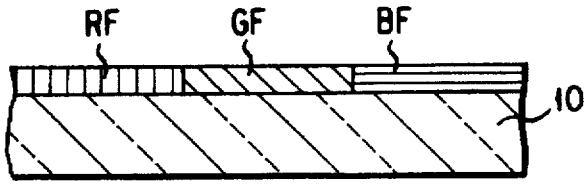

Cobalt blue is prepared as a blue pigment, and an ammonium dichromate/poval photoresist is mixed therewith to prepare a blue pigment dispersion. The resultant blue pigment dispersion is coated on the surface of the substrate and dried. The blue dot positions of the resultant coating film are exposed and developed to form blue filters BF, as shown in FIG. 3B. Following the same procedures as described above, cobalt green is used as a green pigment to form green filters GF, as shown in FIG. 3C.

Figure 3D:
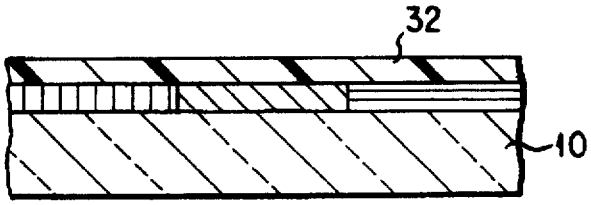
Figure 3E:
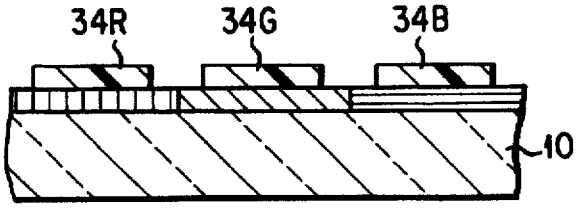
Figure 3F:
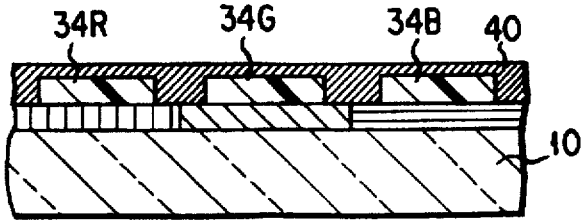
Figure 3G:
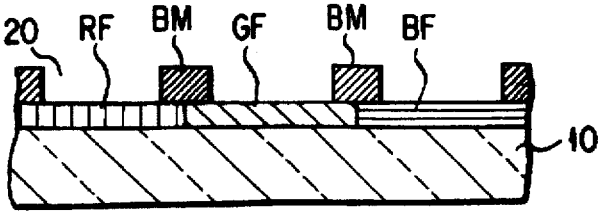

As shown in FIG. 3D, a bisazido/polyvinyl pyrrolidone photoresist is coated on the color filters RF, GF, BR to form a resist layer 32. The green, blue, and red dot positions are exposed and developed by the conventional method to form resist patterns 34R, 34G, and 34B, as shown in FIG. 3E. As shown in FIG. 3F, a graphite suspension 40 is coated on the resultant structure to form a coating film. The resist patterns 34R, 34G, and 34B are decomposed in a treatment with a resist decomposition agent. The resist patterns 34R, 34G, and 34B and the graphite suspension coating film formed thereon are removed by development in which water is sprayed at high pressure of about 4 to 8 kg/cm$^2$. As shown in FIG. 3G, a black matrix layer BM is formed except for the green, blue, and red dot positions, i.e., except for holes 20.

The red pigment dispersion, the blue pigment dispersion, and the green pigment dispersion can be obtained by the following composition.

| | |
|---|---|
| Red pigment dispersion | |
| Sicotrans Red L-2817 | 8 g |
| POVAL EG-40 (available from NIHON GOSEI KAGAKU KOGYO) | 0.9 g |
| Ammonium dichromate (available from KANTO KAGAKU) | 0.05 g |
| Water | 120 g |
| dispersant | balance |
| Blue pigment dispersion | |
| Cobalt Blue X | 8 g |
| POVAL EG-40 (available from NIHON GOSEI KAGAKU KOGYO) | 0.9 g |
| Ammonium dichromate (available from KANTO KAGAKU) | 0.05 g |
| Water | 50 g |
| dispersant | balance |

-continued

| Green pigment dispersion | |
|---|---|
| Dyepyroxide TM-Green #3320 | 70 g |
| POVAL EG-40 (available from NIHON GOSEI KAGAKU KOGYO) | 0.9 g |
| Ammonium dichromate (available from KANTO KAGAKU) | 0.05 g |
| Water | 70 g |
| dispersant | balance |

Any dispersant which can make pigment particles dispersed can be used in the pigment dispersion. An anionic type, nonionic type dispersant or a mixture thereof can be used as the dispersant.

Example of the anionic type dispersants are acrylic base, acryl-stylene type polymer, acryl copolymer, polycarbonates, condensates of naphthalene formalinsulfonate and polyoxyethylenealkylethersulfate. Example of the nonionic type dispersant are polyoxyethylenelaurylether, polyoxyethylene derivative, polyoxyalkylenealkylether, polyoxyethylenenonylphenylether polyoxyethylenesorbitanmonolaurylate.

When a filter substrate was actually formed by the method described above, no pattern peeling occurred during the formation process.

Since the fine particle pigment layers were formed between the black matrix layer and the substrate in the resultant display screen, irregular reflection caused by the black pigment particles was reduced, and the contrast characteristics of the filter substrate were improved.

Examples of a photoresist are chromates/POVAL type, diazonium salts/POVAL type, stilbazol type and chromates/casein type.

Examples of the resist decomposition agent used in the present invention are acids such as $H_2SO_4$, sulfamic acid, and peroxide such as $H_2O_2$, $MnKO_4$, $KIO_4$, and $NaIO_4$.

If required, coroidal silica and water glass can be applied to the color filter layers before BM is formed. Additionally, a silane coupling agent can be coated to improve adhesive force of BM particles.

EXAMPLE 2

The black pigment layers are formed in the gaps between the pigment layer dots in Example 1. However, a substrate may be covered with fine particle pigment layers, and a black pigment layer may be formed thereon. FIGS. 4A to 4F are sectional views for explaining another method of manufacturing the display screen of the present invention.

Figure 4A:
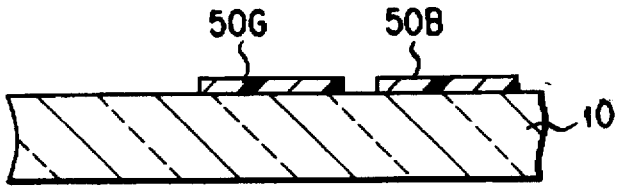
FIGS. 4A to 4F are sectional views for explaining another method of manufacturing the display screen according to the present invention.

An ammonium dichromate/poval photoresist is coated on one surface of a clean transparent substrate 10 to form a coating film. Resist patterns 50G and 50B shown in FIG. 4A are left at the positions where the blue and green dot positions are exposed and developed.

Figure 4B:
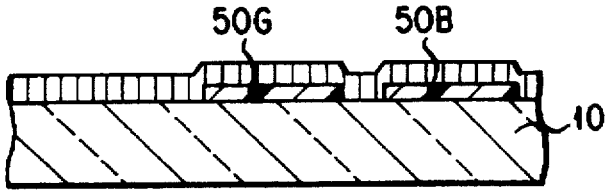
Figure 4C:
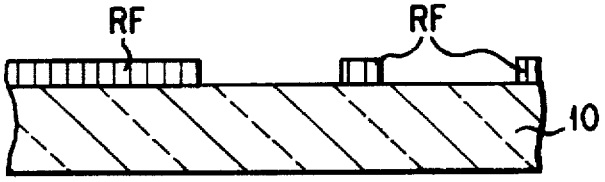

As shown in FIG. 4B, a red pigment fine particle dispersion using red iron oxide serving as a red pigment is coated and dried, and then the resist patterns 50G and 50B are removed using a decomposition agent. As shown in FIG. 4C, red filters RF are formed in regions except for the green and blue dot positions.

Figure 4D:
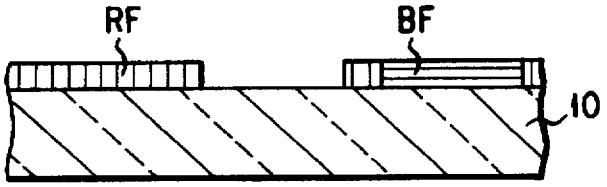
Figure 4E:
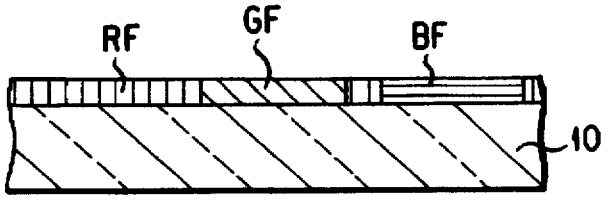

A blue pigment fine particle dispersion obtained by mixing an ammonium dichromate/poval photoresist in cobalt blue serving as a blue pigment is coated to expose and develop the blue dot positions, thereby forming blue filters BF shown in FIG. 4D. Following the same procedures as described above, cobalt green is used to form green filters GF, as shown in FIG. 4E.

A bisazido/polyvinyl pyrrolidone photoresist is coated to form a resist layer. The green, blue, and red dot positions are exposed and developed by the conventional method to form resist patterns. A black matrix BM is formed at positions except for the green, blue, and red dot positions, i.e., except for holes 20, through coating of a graphite suspension, treatment with a decomposition agent, and development.

Figure 4F:
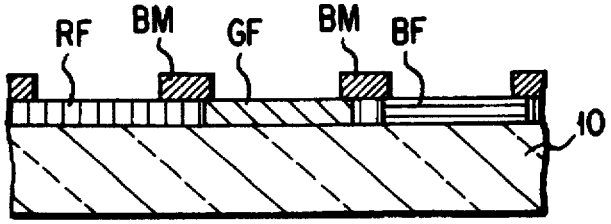

As shown in FIG. 4F, in the resultant filter substrate, the filters RF, GF, and BF consisting of fine particle pigments are formed on the substrate 10 side of the black matrix BM without forming gaps between the adjacent filters. Therefore, irregular reflection caused by the black pigment particles constituting the black matrix can be further reduced as compared with Example 1.

EXAMPLE 3

Examples 1 and 2 have exemplified fine particle pigment layers as circular dots. Example 3 exemplifies fine particle pigment layers having another shape.

Figure 5A:
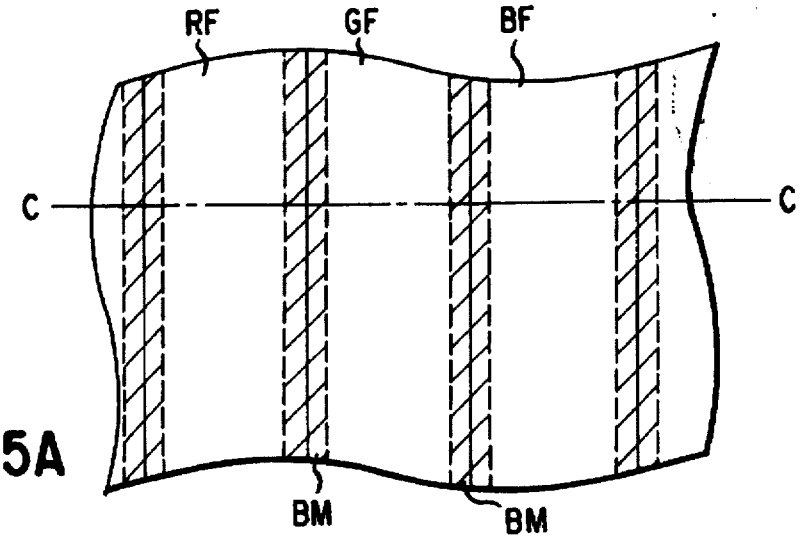
FIG. 5A is a schematic plan view for explaining another display screen according to the present invention.
Figure 5B:
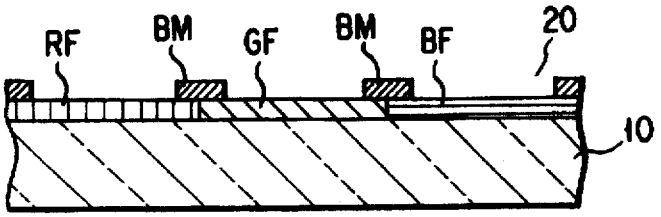
FIG. 5B is a sectional view of the display screen along the line C—C in FIG. 5A.

FIG. 5A is a schematic view of a display screen having stripe-shaped black matrices when viewed from the substrate side. Hatched lines represent regions in which the black matrices are present. FIG. 5B is a sectional view of the display screen along the line C—C in FIG. 5A. As shown in FIGS. 5A and 5B, stripe-shaped filter layers RF, GF, and BF are formed on a substrate 10 adjacent to each other without forming gaps between the adjacent filter layers in this display screen. Stripe-shaped black matrices are formed on the filter layers RF, GF, and BF so as to cover the peripheral regions of the filter layers except for their central portions.

A filter substrate of Example 3 can be manufactured following the same procedures as in Example 1 or 2, and is free from pattern peeling during the formation process.

The ratio of the fine particle pigment layers present between the black pigment particles and the substrate, i.e., the covering ratio, in Example 3 is higher than that in Example 1. An increase in contrast in Example 3 is larger than that in Example 1.

EXAMPLE 4

Example 4 in which the present invention is coated on a color cathode ray tube will be described below.

Figure 6:
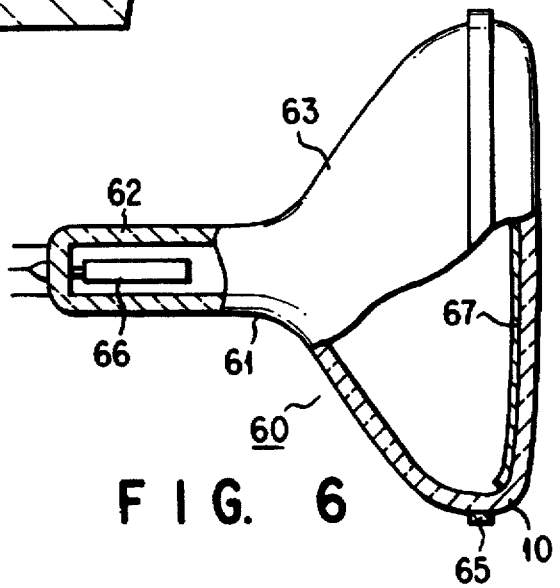
FIG. 6 is a schematic view showing a color cathode ray tube to which the display screen according to the present invention can be coated.

FIG. 6 is a partially cutaway side view showing a cathode ray tube manufactured on the basis of the present invention. A cathode ray tube 60 has an airtight glass envelope 61 which has an evacuated interior. The envelope 61 has a neck 62 and a cone 63 continuously extending from the neck 62. In addition, the envelope 61 has a faceplate 10 sealed by a first glass. An explosion-proof tension band 65 consisting of a metal is wound around the periphery of the side wall of the faceplate 10. An electron gun 66 for emitting electron beams is arranged in the neck 62. A phosphor screen 67 is formed on the inner surface of the faceplate 10. The phosphor screen 67 is constituted by an optical filter layer and a phosphor layer formed thereon, which is excited by electron beams from the electron gun 66 to emit light. A deflection unit (not shown) is arranged outside the cone 63. The deflection unit serves to deflect electron beams to scan over the phosphor screen.

Figure 7:
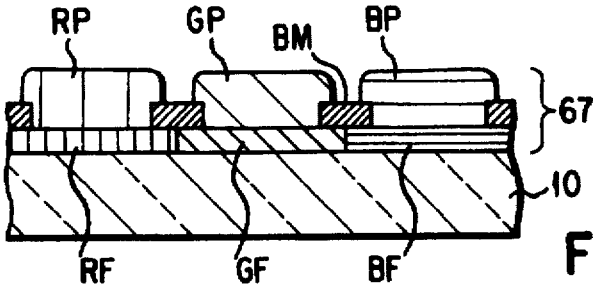
FIG. 7 is a schematic sectional view for explaining a phosphor screen in FIG. 6.

FIG. 7 is a view for explaining the structure of the phosphor screen 67.

A phosphor screen which is obtained by forming phosphor layers on, e.g., the filter substrate of Example 1, 2, or 3, can be used as the phosphor screen 67. As shown in FIG. 7, red, green, and blue emission phosphor layers RP, GP, and BP having emission colors corresponding to the red, green, and blue filters RF, GF, and BF consisting of the fine particle pigment layers are formed in the corresponding holes between the black matrices BM. The transmittance of the faceplate 10 serving as a transparent substrate is about 90%. A clear faceplate is used.

According to the color cathode ray tube having the above phosphor screen, the emission brightness levels of the phosphor layers RP, GP, and BP are proportional to the transmittances of the color filters RF, GF, and BF, respectively. In addition, since the faceplate is also clear, attenuation of the emission components of the phosphors is minimized. On the other hand, the transmittance of each color filter is low for light except for the emission component of the corresponding phosphor. Light components of external light (incident in a upward direction on the substrate in FIG. 7) except for the emission component of each phosphor, e.g., light components except for red color light, are attenuated in the red filter RF in proportion to the square of the low transmittance. Therefore, the reflected components of the external light are attenuated by the corresponding color filters, thereby increasing the contrast.

Since the red, green, and blue fine particle pigment layers having an average particle size of 0.01 to 0.2 μm are formed on the substrate side of the black pigment particles having an average particle size of 0.2 to 5 μm, irregular reflection is reduced at the boundary with the substrate. Even if the transmittance of the substrate is increased, components irregularly reflected by the black pigment particles can be reduced, thereby preventing a decrease in contrast.

The effect of the filters on the front surfaces of the phosphor layers can be maximized.

In the phosphor screen of this color cathode ray tube, phosphor layers may be formed in holes by the conventional method after a black matrix is formed in each example described above.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A display screen comprising:

a transparent substrate having an inner surface and an outer surface;

optical filter layers each containing color pigment particles having an average particle size of 0.2 μm or less and each formed on said inner surface of said transparent substrate as rectangular or circular dots or stripes, the optical filter layers each having a first surface which faces the said inner surface of said transparent substrate and each having a second surface respectively opposite to each said first surface;

a black matrix layer containing black pigment particles having an average particle size of 0.2 to 5 μm and at least a part of which is formed on each said second surface of said optical filter layers formed to cover peripheral regions of said filter layers except for central portions thereof; and phosphor layers formed on said optical filter layers and having an emission color corresponding to a color of a pigment contained in said optical filter layers.

2. A screen according to claim 1, wherein said optical filter layers include a red optical filter layer containing red pigment particles, a blue optical filter layer containing blue pigment particles, and a green optical filter layer containing green pigment particles.

3. A screen according to claim 1, wherein gaps between said filter layers are buried with black pigment particles.

4. A screen according to claim 1, wherein said optical filter layers are formed without any gap.

5. A method of manufacturing a display screen, comprising the steps of:

providing a transparent substrate having an inner surface and an outer surface;

coating and drying a color pigment dispersion containing color pigment particles having an average particle size of 0.2 μm or less on said inner surface of said transparent substrate to form a color pigment layer, and patterning said color pigment layer to form color optical filter layers as rectangular or circular dots or stripes, the optical filter layers each having a first surface side which faces said inner surface of said transparent substrate and each having a second surface respectively opposite to each said first surface;

coating and drying a black pigment dispersion containing black pigment particles having an average particle size of 0.2 to 5 μm on said color optical filter layers to form a black pigment layer at least part of which is formed on each said second surface of said optical filter layers, and patterning said black pigment layer to partially remove said black pigment layer except for peripheral regions of said pigment layers so as to expose at least central portions of said optical filter layers, thereby obtaining a black matrix layer covering said peripheral regions of said color optical filter layers; and coating a slurry containing a phosphor on said color optical filter layers to form a phosphor slurry layer, and patterning said phosphor slurry layer to optionally form phosphor layers having an emission color corresponding to a color of a pigment containing said optical filter layers on said optical filter layers.

6. A method according to claim 5, wherein, in the optical filter layer formation step, as the color pigment dispersion, a red pigment dispersion containing red pigment particles, a blue pigment dispersion containing blue pigment particles, and a green pigment dispersion containing green pigment particles are used; and the optical filter layer formation step is repeated to optionally form a red optical filter layer containing red pigment particles, a blue optical filter layer containing blue pigment particles, and a green optical filter layer containing blue pigment particles.

7. A method according to claim 6, wherein the optical filter layer formation step comprises a process for repeating the step of coating a dispersion including a color pigment and a resist on a substrate to form a coating film, the step of exposing said coating film, and the step of developing the exposed coating film in accordance with the number of colors.

8. A method according to claim 5, wherein said color optical filter layers include a first color optical filter layer and a second color optical filter, and the optical filter layer formation step comprises the steps of:

coating a resist solution on a substrate to form a resist film prior to coating of a first color pigment dispersion;

exposing and developing said resist film to form a resist film pattern in a region where said second color optical filter layer is to be formed;

coating the first pigment dispersion on said resist film pattern and drying the first pigment dispersion to form a coating film;

coating a resist decomposition agent on said first pigment dispersion coating film to remove said resist film pattern and said first color pigment dispersion coating film formed thereon in the region where said second color optical filter layer is to be formed, thereby exposing said substrate in the region;

coating a second pigment dispersion on the exposed substrate to form a coating film; and exposing and developing the coating film to pattern said second color optical filter layer.

* * * * *